United States Patent [19]

Cave

[11] Patent Number: 4,730,098

[45] Date of Patent: Mar. 8, 1988

[54] ELECTRIC ELECTRODE-TYPE WATER HEATER

[76] Inventor: Norman M. Cave, 355 Mottram Road, Stalybridge, Cheshire, England

[21] Appl. No.: 760,660

[22] Filed: Jul. 30, 1985

[30] Foreign Application Priority Data

Aug. 1, 1984 [GB] United Kingdom ..... 8419987

[51] Int. Cl.[4] ..... H05B 3/60; F24H 1/10; F22B 1/30

[52] U.S. Cl. ..... 219/291; 219/288; 219/289; 219/293; 338/80

[58] Field of Search ..... 219/284–295, 219/271–276; 338/80–86

[56] References Cited

U.S. PATENT DOCUMENTS

| | | | |
|---|---|---|---|
| 991,877 | 5/1911 | Nichols | 219/291 |
| 1,273,451 | 7/1918 | Bouzo | 219/291 X |
| 1,386,607 | 8/1921 | De Raignau | 219/293 |
| 1,480,515 | 1/1924 | De Marchis | 219/291 |
| 1,491,584 | 1/1934 | Sexton | 219/291 |
| 2,444,508 | 7/1948 | Hormi | 219/291 |
| 2,481,958 | 9/1949 | Vidiche | 219/291 X |
| 3,005,083 | 10/1961 | Mendoza et al. | 219/285 |

FOREIGN PATENT DOCUMENTS

| | | | |
|---|---|---|---|
| 324180 | 6/1935 | Italy | 219/288 |
| 574909 | 1/1946 | United Kingdom | 219/293 |

*Primary Examiner*—Anthony Bartis
*Attorney, Agent, or Firm*—Pearson & Pearson

[57] ABSTRACT

A heating device for an electrically conductive fluid, such as water, has a vessel with a fluid inlet and a fluid outlet. A plurality of closely spaced parallel electrode plates within a container having holes therein and a plurality of wall structures within the vessel between the electrode plates cooperate with the vessel walls and the holes in the electrode plates to define a number of fluid passages which extend alongside each other transversely through the plates. The passages are successively interconnected to each other in series and to the inlet and outlet so that the fluid introduced therein flows along the passages backwards and forwards in the opposite directions through the plates to the outlets. The heating device also has electrical terminals for connection to a source of power with alternate electrodes being connected to different terminals.

5 Claims, 1 Drawing Figure

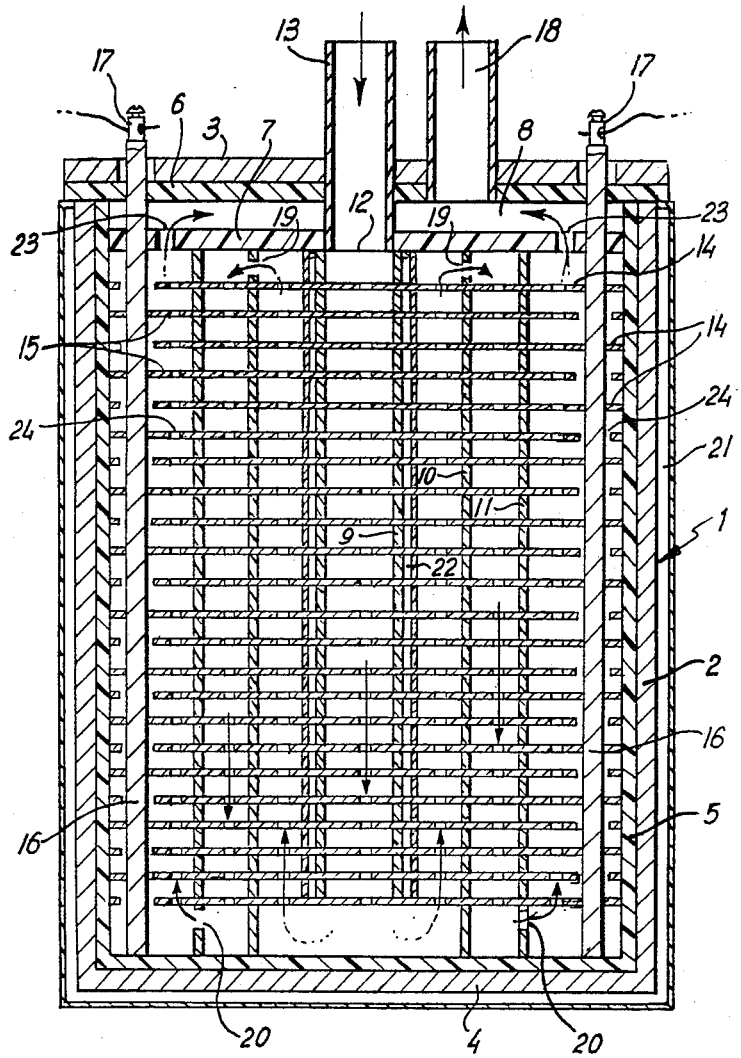
13
18
17
17
6
3
7
8
12
19
19
23
23
14
14
15
24
24
21
10
11
1
9
22
2
16
16
5
20
4
20

ELECTRIC ELECTRODE-TYPE WATER HEATER

This invention relates to a device for heating fluids, and is particularly although not exclusively concerned with a water heating device.

The primary object of the invention is to provide a device with which a relatively large rise in temperature of a body of fluid can be achieved in a short period of time in an efficient and convenient manner.

According to the invention therefore there is provided a heating device comprising closely-spaced electrodes adapted for connection to a source of electric power, and fluid flow passages running in opposite directions through said electrodes from an inlet to an outlet and the oppositely running passages are perpendicularly intersected by the electrodes.

With this arrangement, in use, electrical energy from the power source is dissipated conductively and/or capacitively between the electrodes such that heat is generated within the body of fluid and/or within the material of the electrodes. Due to the mode of fluid flow there is a continuous interchange of heat between the fluid and the electrodes whereby heat can be generated and transmitted through the fluid in a particularly effective and efficient manner.

Most preferably the electrodes comprise plates which extend parallel, or generally parallel, to each other. Preferably also, the the passages run in opposite directions transversely, particularly perpendicularly, to such plates, there being provided appropriate apertures or perforations in the plates for the fluid.

Conveniently there may be multiple tube segments disposed coaxially inside each other in spaced relation to define therebetween the said passages. These tube segments may be formed from a suitable plastic material which is electrically insulating and capable of containing the heated fluid without undue deleterious effects.

The electrodes may be formed from any suitable metal or other material having requisite thermal and electrical properties, and also adequate resistance to attack by the heated fluid. Stainless steel is a suitable material.

The electrodes are preferably used with a.c. supply. Preferably there are more than two electrodes and these may be connected alternately to different phases or different polarities of the supply.

It is visualised that the heating device of the invention may have particular application in the heating of water to produce hot water or steam for any suitable purpose and in any suitable context whether domestic, commercial or industrial. The heated fluid may be dispensed for use, e.g., for washing purposes, or may be used in connected equipment, e.g. to heat a further fluid or other material or to operate steam-driven apparatus or for any other suitable purpose.

The invention will now be described further by way of example only and with reference to the accompanying drawing the sole view of which is a diagrammatic sectional view of one form of a heating device according to the invention.

The device comprises a stainless steel vessel 1 having a cylindrical body 2 closed at its top and bottom ends respectively with a lid 3 and a bottom wall 4.

The vessel 1 has an inner vessel or lining 5 of an insulating plastic material which covers the inner surfaces of the body 2 and the bottom wall 4. The undersurface of the lid 3 is covered with a layer 6 of this plastic material and a disc 7 of the same material is fixed below and parallel to this so as to define an outlet cavity 8 therebetween.

Short tube segments 9, 10, 11 formed from the same plastic material are interposed between pairs of electrode plates and are fixed in position coaxially relative to each other and to the cylindrical body 2. The uppermost of the plurality of coaxially aligned tube segments 9 and a copper inlet tube 13 which extends upwardly through the lid 3 are bonded within the hole 12 in disc 7. The lowermost tube segment 9 terminates above the bottom wall 4. The uppermost tube segments 10 and 11 and the lowermost tube segments 10 and 11 are fixed to disc 7 and lining 5.

Each of the tube segments 9 to 11 disposed between each pair of electrode discs 14 and 15 have their top and bottom ends in engagement with a respective electrode disc with the tube segments serving as spacers between the electrode discs. The discs 14, 15 are perforated stainless steel plates one-sixteenth of an inch thick (1.6 mm) and one-quarter of an inch apart (6.4. mm). At two diametrically opposed positions there are longitudinally extending conductive rods 16. Each rod 16 is connected to a respective set of alternate discs 14, 15, the other discs 15 or 14 being cut away as shown at 24 around the rod 16 to permit this. The rods 16 extend upwardly through the lid 3 and connect with electrical terminals 17.

A short copper outlet tube 18 extends through the lid 3 into communication with the cavity 8 between the lid 3 and the disc 7.

The inlet tube 13 is connected via piping to a water supply and the outlet tube 18 is connected via piping to a tap or other dispense outlet or apparatus where hot water is required. The terminals 17 are connected respectively to neutral and live wires of a.c. mains supply, and the body 2 of the vessel 1 is connected, if required, to earth.

In use, the a.c. supply is switched on and the water is caused to flow through the heating device from the inlet tube 13 to the outlet tube 18. The path of the water is down through the tube segments 9, up between the tube segments 9, 10, through side holes 19 in the uppermost tube segment 10, down between the tube segments 10 and 11, through side holes 20 in the lowermost tube segments 11, up between the tube segments 11 and the body 2, and through holes 23 in the disc 7 into the cavity 8. In flowing upwardly and downwardly as described above the water passes through the perforations 22 and 24 in the discs 14, 15. It will be noted that the stainless steel vessel 1 is completely isolated from the water by the plastic lining 5 and the lid cover 6.

The electric supply produces opposite potentials between each pair of adjacent discs 14 and 15 and this gives rise to dissipation of electrical energy conductively and capacitively between the electrodes 14, 15 through the water. Resistive heating of the water and of the discs 14, 15 is thereby effected and there is a constant interchange of such heat between the water and the discs 14, 15. The result of this is that the water is heated to a high temperature in a particularly efficient and effective manner. For example, it is possible to boil two liters of water from room temperature in less than 10 seconds without undue consumption of electric power.

The device can be installed and provided with appropriate control circuitry in any suitable manner. Thus, for example, the device may be incorporated in a domestic hot water system and arranged so that the electric supply is automatically switched on when the water flows. Temperature adjustment may be effected by adjusting water flow rate and/or electric supply voltage or current.

It is of course to be understood that the invention is not intended to be restricted to the details of the above embodiment which are described by way of example only. Thus, for example, the device is not restricted to use in the context of production of hot water—the device may also be used for producing steam or for any other suitable purpose.

Whilst normal 250 V 50 Hz a.c. mains power supply is preferred (whether two or three phase) it is also possible to use d.c. supply, e.g., from batteries, if a suitable device is provided to convert the d.c. to alternating supply. There may also be advantage to using a frequency of alternation appreciably higher than the normal mains frequency. The use of stainless steel discs and counterflow water paths avoids or minimises production of deposits due to polarisation.

The body 2 and the lid 3 are preferably earthed to avoid generation of radio frequency signals which may cause interference with nearby radio or television equipment. Alternatively or additionally a highly conductive earthed screen may be incorporated around the periphery of the device.

To improve efficiency, a thermally insulating barrier layer 21 may be provided around the periphery of the device internally or externally of the body 2 (and possibly also the lid 3). This layer may comprise, as shown, an evacuated space. Alternatively or additionally a foam plastic material or the like may be used.

It is also possible to provide a thermally insulating barrier layer 22, which may also comprise an evacuated space and/or a foam plastic material or the like, around the periphery of the tube segments 9 to avoid undue dissipation of heat from the body of water flowing upwardly between tube segments 9 and 10 into the cold water flowing downwardly through tube segments 9 from inlet tube 13.

The conductive rods 16 may be insulated between the connections to the discs 14, 15 to ensure that the electrical heating effect is concentrated between the confronting surfaces of the electrodes.

The lid 3 may be releasably fastened to the body 2 in any suitable manner so that access can be had to the interior of the device for maintenance purposes.

The discs 14, 15 shown in the drawing may be sealed via insulating material relative to the rods and the cylindrical body 2 so that water circulates under pressure through the perforations 22 in the discs thereby giving a scouring action preventing accumulation of any deposits on the discs. If desired any suitable filtering or ion exchange arrangement or the like may be used in conjunction with the device.

As mentioned, the discs 14, 15 will be connected to opposite polarities and the final disc through which the water passes before leaving the device will preferably be at neutral potential where a.c. mains is used.

Heating control may be achieved, as described by adjusting flow rate. Alternatively or additionally, the voltage or frequency of the electrical supply may be adjusted, or the supply may be switched on and off with a thermostat.

The tube segments 9-11 may be plastics or may be earthed copper tubes which are plastic electrode coated or otherwise insulated relative to the discs 14, 15.

The device can be used for desalination purposes as well as for generating hot water and steam.

I claim:

1. A heating device for heating an electrically conductive fluid comprising a vessel having a bottom wall, side walls and a top with a fluid inlet and a fluid outlet through a lid closing the top of the vessel, a plurality of closely-spaced electrode plates extending substantially parallel to each other substantially horizontally across the vessel between said bottom wall and said lid, said plates having holes therein, a plurality of spaced wall structures within said vessel between each pair of plates, means including said plurality of wall structures, the side walls and bottom wall of said vessel, said lid and the holes in said plates defining a plurality of separate fluid passages which extend alongside each other transversely through the plates from said lid to said bottom wall, said passages being interconnected in series to each other to form a continuous path, the opposite ends of said flow path being connected to the said inlet and outlet so that fluid introduced into said inlet is constrained to flow along said passages backwards and forwards in opposite directions through said plates to said outlet, and electrical terminals for connection to a source of electric power, alternate said electrodes being connected to different said terminals.

2. A device according to claim 1, characterized in that said wall structures comprise spaced coaxially disposed tube segments between each pair of electrode plates.

3. A device according to claim 1, characterized in that said vessel is cylindrical.

4. A device according to claim 1, wherein said electrodes comprise parallel circular discs, said passages are defined between multiple coaxially disposed tube segments forming said wall structures and extending perpendicularly to the discs, and said electrodes and said passages are disposed within a cylindrical container defining said vessel with said tubes extending coaxially relative to said container.

5. A heating device for heating a fluid comprising a vessel having top and bottom ends and side walls and provided with a fluid inlet and a fluid outlet, a plurality of closely-spaced horizontally disposed electrode plates within the vessel extending substantially parallel to each other, said plates having holes therein, a plurality of spaced wall structures between each adjacent pair of electrode plates, means including said top end, bottom end and side walls of said vessel, said plurality of wall structures and said holes in said electrodes plates defining at least three separate coaxially disposed fluid passages extending through said electrode plates from the top end to the bottom end of said vessel said passages being interconnected in series with each other to form a continuous flow path having one end conncted to said fluid inlet and its opposite end connected to said fluid outlet so that fluid introduced into said inlet is constrained to flow along said passages backwards and forwards in opposite directions through said plates to said outlet, and electrical terminals for connection to a source of electric power, alternate said electrodes being connected to different said terminals.

* * * * *